US011791111B2

(12) United States Patent
Kuroki et al.

(10) Patent No.: US 11,791,111 B2
(45) Date of Patent: Oct. 17, 2023

(54) SWITCH DEVICE AND METHOD FOR PRODUCING SWITCH DEVICE

(71) Applicant: OMRON Corporation, Kyoto (JP)

(72) Inventors: Kenji Kuroki, Suita (JP); Kenji Shinohara, Nagaokakyo (JP)

(73) Assignee: OMRON Corporation, Kyoto (JP)

( * ) Notice: Subject to any disclaimer, the term of this patent is extended or adjusted under 35 U.S.C. 154(b) by 169 days.

(21) Appl. No.: 17/429,397

(22) PCT Filed: Mar. 13, 2020

(86) PCT No.: PCT/JP2020/011141
§ 371 (c)(1),
(2) Date: Aug. 9, 2021

(87) PCT Pub. No.: WO2020/184708
PCT Pub. Date: Sep. 17, 2020

(65) Prior Publication Data

US 2022/0148828 A1 May 12, 2022

(30) Foreign Application Priority Data

Mar. 14, 2019 (JP) ..... 2019-047347

(51) Int. Cl.
*H01H 13/10* (2006.01)
*H01H 11/04* (2006.01)
(Continued)

(52) U.S. Cl.
CPC ..... *H01H 13/10* (2013.01); *H01H 11/04* (2013.01); *H01H 13/183* (2013.01); *H01H 13/06* (2013.01); *H01H 2229/05* (2013.01)

(58) Field of Classification Search
CPC ..... H01H 3/125; H01H 13/705; H01H 13/14; H01H 13/04; H01H 13/10; H01H 13/70;
(Continued)

(56) References Cited

U.S. PATENT DOCUMENTS 4,324,956 A * 4/1982 Sakakino ..... H01H 15/005 200/16 R
2016/0099119 A1 4/2016 Miyosh et al.
2018/0025855 A1 1/2018 Tanaka

FOREIGN PATENT DOCUMENTS

DE 102014008410 A1 5/2015
JP H9-274827 A 10/1997
(Continued)

OTHER PUBLICATIONS

An English translation of the International Search Report ("ISR") of PCT/JP2020/011141 dated May 19, 2020.
(Continued)

*Primary Examiner* — Ahmed M Saeed
(74) *Attorney, Agent, or Firm* — METROLEX IP LAW GROUP, PLLC

(57) ABSTRACT

A switch device includes a plurality of lead frames that is conductive and configured to electrically connectable to an external device, a contact-separation mechanism configured to allow the plurality of lead frames to be electrically connected to and separated from each other, and an electric element configured to connect the plurality of lead frames to each other. The electric element is surface-mounted on the lead frames and sealed with resin. In each of the lead frame, the boundary, such as a groove or a notch, is formed along the outer edge of the arrangement position of the electric element.

9 Claims, 9 Drawing Sheets

(51) Int. Cl.
*H01H 13/18* (2006.01)
*H01H 13/06* (2006.01)

(58) Field of Classification Search
CPC ..... H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20
See application file for complete search history.

(56) References Cited

FOREIGN PATENT DOCUMENTS

| | | | |
|---|---|---|---|
| JP | 2016-76356 | A | 5/2016 |
| JP | 6188155 | B2 | 8/2017 |
| JP | 2018-14276 | A | 1/2018 |
| WO | 2019/188474 | A1 | 10/2019 |

OTHER PUBLICATIONS

The Written Opinion("WO") of PCT/JP2020/011141 dated May 19, 2020.

* cited by examiner

SWITCH DEVICE AND METHOD FOR PRODUCING SWITCH DEVICE

TECHNICAL FIELD

The disclosure relates to a switch device including a plurality of lead frames that is conductive and configured to be electrically connectable to an external device, a contact-separation mechanism configured to allow the plurality of lead frames to be electrically connected to and separated from each other, and an electric element configured to connect the plurality of lead frames to each other, and a method for manufacturing such a switch device.

BACKGROUND ART

For example, there is widely used a switch device that is incorporated in an external apparatus such as an electric component of an automobile and connects or separates an electrical connection of the external device. As such a switch device, Patent Document 1 discloses a switch device capable of detecting whether a connection between an external apparatus and an electric wire is in a normal state or a disconnection or short-circuit failure state by detecting a resistance value of a detection circuit. In the switch device disclosed in Patent Document 1, a resistor attached to a holding member (base) by soldering is accommodated in a case together with components such as a coil spring and a movable contact.

PRIOR ART DOCUMENT

Patent Document 1: Japanese Patent No. 6188155

SUMMARY

However, in the switch device disclosed in Patent Document 1, since the attached resistor is accommodated in the case in an exposed state, there is a possibility that reliability of a solder joint is lowered due to deterioration such as corrosion of the solder joint due to an influence of moisture in the surrounding air, a sulfide gas, and the like.

One or more embodiments have been made in view of such circumstances, to provide a switch device capable of maintaining reliability.

One or more embodiments have been made to provide a method for manufacturing such a switch device.

A switch device according to one or more embodiments may include a plurality of lead frames that is conductive and configured to be electrically connectable to an external device, a contact-separation mechanism configured to allow the plurality of lead frames to be electrically connected to and separated from each other, and an electric element configured to connect the plurality of lead frames to each other, in which the electric element is surface-mounted on the plurality of lead frames and sealed with resin.

Further, a switch device may further include a casing accommodating a part or all of the plurality of lead frames, the contact-separation mechanism, and the electric element that is sealed with resin on the plurality of lead frames.

In a switch device, an electric element may be a single electric element.

In a switch device, an electric element may have a plurality of electric elements.

In a switch device, a plurality of electric elements may have a substantially rectangular shape, and may be arranged side by side on the plurality of lead frames in a manner in which long sides of one electric element are parallel to those of other electric element.

In a switch device, each of lead frames may include a boundary disposed along an outer edge of an arrangement position of the electric elements.

Furthermore, a method is disclosed for manufacturing a switch device including a plurality of lead frames that is conductive and configured to be electrically connectable to an external device, a contact-separation mechanism configured to allow the plurality of lead frames to be electrically connected to and separated from each other, and an electric element configured to connect the plurality of lead frames to each other The method may include a pressing step of forming the lead frames from a conductive plate, a placing step of placing the electric element on the plurality of lead frames formed in the pressing step, a resin sealing step of sealing, with resin, the electric element placed in the placing step and, thus, forming a mold body, and an assembling step of assembling components including the contact-separation mechanism and the mold body formed in the resin sealing step.

In a switch device and a method for manufacturing the switch device according to one or more embodiments, the electric element may be sealed with resin.

In a switch device and a method for manufacturing a switch device according to one or more embodiments, the electric element surface-mounted on the lead frames may be sealed with resin. This may prevent, for example, deterioration such as corrosion due to an influence of moisture in the air, a sulfurized gas, and the like, maintains reliability of a solder joint, and exhibits other excellent effects.

DETAILED DESCRIPTION

MODE FOR CARRYING OUT THE INVENTION

Figure 1:
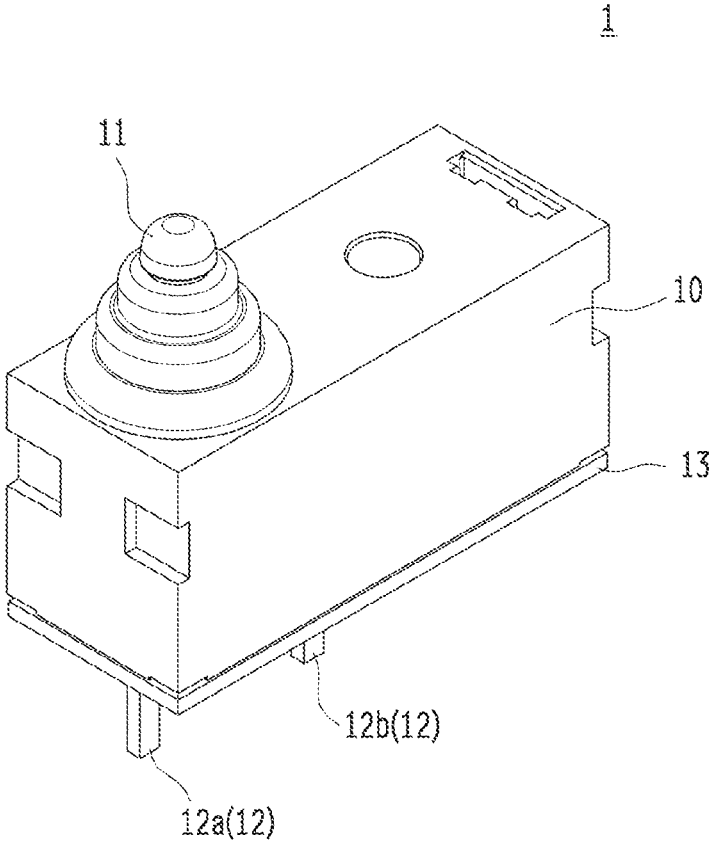
FIG. 1 is a diagram illustrating a schematic perspective view of an example of an external appearance of a switch device according to one or more embodiments.

Hereinafter, an embodiment of the invention will be described with reference to the drawings.

<Application Example>

A switch device according to one or more embodiments, may be used for various products and applications including an electrical system or the like of a vehicle such as an automobile and a motorcycle. Specific examples of the switch device include a latch switch that detects an opening and closing state of a door of an automobile. Further, embodiments may not be limited to automobiles and motorcycles, and may be used for various industrial detection switches and the like. Hereinafter, an example of a switch device including one or a plurality of electric elements will be described with reference to the drawing describing such a switch device as a switch device 1.

<Switch Device 1>

FIG. 1 is a schematic perspective view illustrating an example of an external appearance of the switch device 1 disclosed herein. Note that, as for directions of the switch device 1 herein disclosed, a right front side is represented as a front side, a left rear side is represented as a rear side, a left front side is represented as a left side, a right rear side is represented as a right side, an upper side is represented as an upper side, and a lower side is represented as a lower side in FIG. 1. However, the directions are for convenience of description and not for limiting an attachment direction of the switch device 1. The switch device 1 illustrated in FIG. 1 is a switch with a built-in resistor, having an A contact specification, is electrically connected to an external device such as a door of an automobile to be used, and can detect occurrence of abnormality such as disconnection or short circuit in wiring of the external device. The A contact specification is a specification in which an electric circuit of an N.O. type (normally open type) is formed. Note that the switch device 1 disclosed herein is not limited to the A contact specification, and can be configured as the switch device 1 having a B contact specification in which an electric circuit of an N.C. type (normally closed type) is formed.

The switch device 1 includes a casing 10 having a substantially rectangular parallelepiped shape, and has a substantially rectangular parallelepiped outer shape as a whole by accommodating various members in the casing 10. A lower surface of the casing 10 having a substantially rectangular parallelepiped shape is opened, and a lower surface of a mold body 13 accommodated and integrated in the casing 10 is a lower surface of the switch device 1. On an upper surface of the casing 10, a movable member 11 that can be pushed into the casing 10 by receiving pressure from outside is inserted into a position on the left side with respect to a center in front view. The movable member 11 is a shaft having a substantially columnar shape, and is inserted into an insertion hole (not illustrated) opened in the upper surface of the casing 10. FIG. 1 illustrates a mode in which a periphery of the movable member 11 and the insertion hole is covered with a rubber packing.

Two terminals 12 connected to an external device protrude from a position on the left side and a vicinity of the center of the lower surface of the mold body 13 included in the switch device 1. In the following description, when the protruding terminals 12 are particularly distinguished, the terminal 12 on the left side will be referred to as a first terminal 12*a*, and the terminal 12 near the center will be referred to as a second terminal 12*b*. When the switch device 1 is used as the switch device 1 having the A contact specification, for example, the first terminal 12*a* is a COM terminal, and the second terminal 12*b* is an N.O. terminal. Further, when the switch device 1 is used as the switch device 1 having the B contact specification, the terminal 12 serving as an N.C. terminal can be provided. Which terminal 12 is used as the COM terminal, the N.O. terminal, or the N.C. terminal can be appropriately designed in accordance with the circuit configuration in the switch device 1 or a design of an external device or the like.

Figure 2:
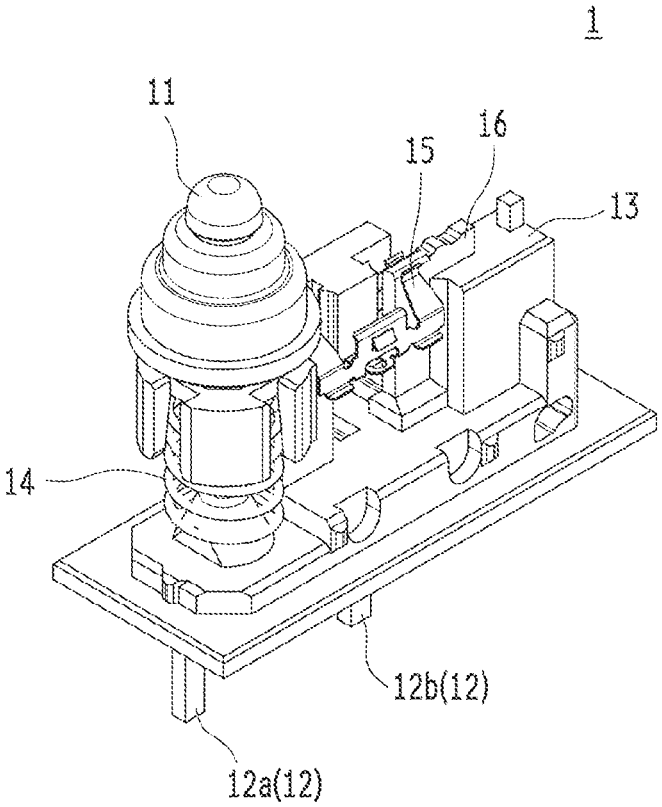
FIG. 2 is a diagram illustrating a schematic perspective view of an example of an internal structure of a switch device according to one or more embodiments.

FIG. 2 is a schematic perspective view illustrating an example of an internal structure of the switch device 1 disclosed herein. FIG. 2 illustrates a state in which the casing 10 is removed from the switch device 1 in FIG. 1. Inside the switch device 1, the movable member 11 having a substantially cylindrical shape and covered with the rubber packing is provided upright on the mold body 13 forming a lower part so as to be inserted. A biasing member 14 such as a compression coil spring that biases the movable member 11 upward pressed downward is attached to the movable member 11 so as to wind around the movable member 11. Further, a conductive movable contact 15 formed by using a metal plate is attached to the movable member 11, and the movable contact 15 moves in an up-down direction together with the movable member 11 moving in the up-down direction to constitute a contact-separation mechanism.

In the casing 10 of the switch device 1, components such as a lead frame 16 and an electric element 17 (see FIG. 3 and other drawings) to be described later are sealed with resin in various shapes and accommodated as the mold body 13 integrated in the lower part.

In the switch device 1 thus formed, when the movable member 11 is pressed downward, the movable member 11 moves downward against a biasing force of the biasing member 14, presses the movable contact 15 attached to the movable member 11, and moves the movable contact 15 to change an open and close state of the electric circuit in the switch device 1. When the pressing of the movable member 11 is released, the movable member 11 moves upward by the biasing force of the biasing member 14, the movable contact 15 attached to the movable member 11 returns to a state before the pressing, and the open and close state of the electric circuit in the switch device 1 is returned to an original state. Note that in the change in the open and close state of the electric circuit by the movable contact 15, the electric circuit can be closed in response to pressing of the movable member 11 or can be opened.

Figure 3:
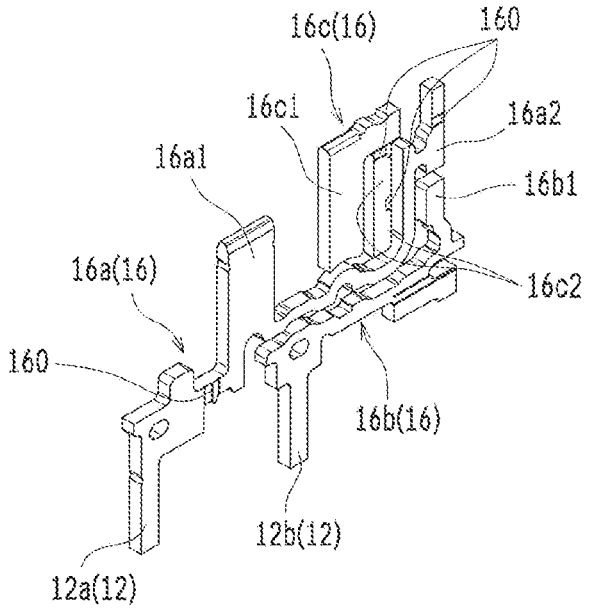
FIG. 3 is a diagram illustrating a schematic perspective view of an example of a lead frame included in a switch device according to one or more embodiments.
Figure 4:
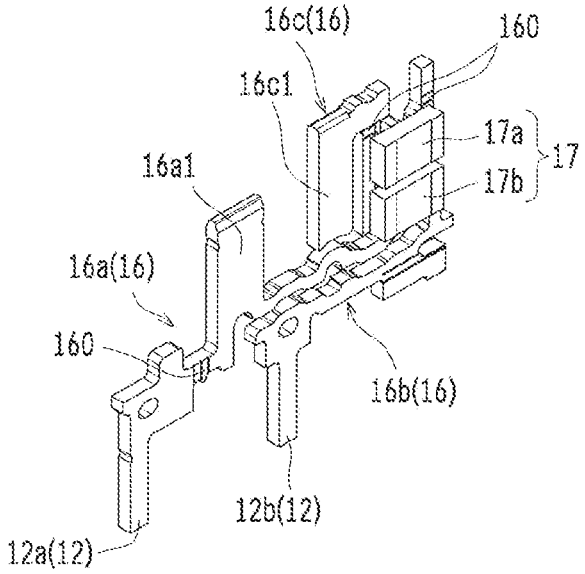
FIG. 4 is a diagram illustrating a schematic perspective view of an example of a lead frame and an electric element included in a switch device according to one or more embodiments.

FIG. 3 is a schematic perspective view illustrating an example of the lead frame 16 included in the switch device 1 disclosed herein. FIG. 4 is a schematic perspective view illustrating an example of the lead frame 16 and the electric element 17 included in the switch device 1 disclosed herein. FIG. 3 shows the lead frame 16 sealed with resin in the mold body 13 of the switch device 1 removed, and FIG. 4 shows a state in which the electric element 17 is placed on the lead frame 16.

The lead frame 16 is obtained by molding a conductive metal plate by a molding method such as press working, and a part of the lead frame 16 is molded as the terminal 12 connected to an external device. In the examples in FIGS. 3 and 4, the lead frame 16 is configured as three members. In the following description, when the individual lead frame 16 is particularly distinguished, the lead frame 16 integrally molded with the lower left first terminal 12*a* will be referred to as a first lead frame 16*a*, the lead frame 16 integrally molded with the lower center second terminal 12*b* will be referred to as a second lead frame 16*b*, and the upper lead frame 16 separated from the terminal 12 will be referred to as a third lead frame 16*c*.

The first lead frame 16*a* is provided with portions such as a first fixed contact 16*a*1 and a first placing portion 16*a*2 in addition to the first terminal 12*a*. The first fixed contact 16*a*1 functions as a part of the contact-separation mechanism, and is electrically connected to and separated from the movable contact 15 in accordance with operation of the movable contact 15. The electric element 17 can be surface-mounted on the first placing portion 16*a*2, and is a portion to which solder is applied in order to attach the electric element 17.

The second lead frame 16*b* is provided with a portion such as a second placing portion 16*b*1 in addition to the second terminal 12*b*. The electric element 17 can be surface-mounted on the second placing portion 16*b*1, and is a portion to which solder is applied in order to attach the electric element 17.

The third lead frame 16*c* is provided with portions such as a second fixed contact 16*c*1 and a third placing portion 16*c*2. The second fixed contact 16*c*1 functions as a part of the contact-separation mechanism, and is always in electrical contact with the movable contact 15 regardless of the operation of the movable contact 15. Thus, the first fixed contact 16*a*1 and the second fixed contact 16*c*1 are electrically connected to and separated from each other by the operation of the movable contact 15. The electric element 17 can be surface-mounted on the third placing portion 16*c*2, and is a portion to which solder is applied in order to attach the electric element 17. One or two electric elements 17 can be attached to the third placing portion 16*c*2.

FIG. 4 illustrates a state in which two electric elements 17 are attached to the lead frame 16. In the following description, when the individual electric element 17 is particularly distinguished, the upper electric element 17 will be described as a first electric element 17*a*, and the lower electric element 17 will be described as a second electric element 17*b*.

The electric element 17 is a surface mounting type element using one element or a plurality of elements such as a resistor and a capacitor, and is molded in a flat substantially rectangular parallelepiped shape. A mode exemplified in FIG. 4 illustrates a mode in which the first electric element 17*a* is surface-mounted so as to bridge between the first placing portion 16*a*2 and the third placing portion 16*c*2, and the second electric element 17*b* is surface-mounted so as to bridge between the second placing portion 16*b*1 and the third placing portion 16*c*2.

The first electric element 17*a* and the second electric element 17*b* having substantially rectangular parallelepiped shapes are arranged side by side on the lead frame 16 in a manner in which long sides of one electric element are parallel to those of other electric element. The lead frame 16 is provided with a boundary 160 such as a groove or a notch along an outer edge of an arrangement position of the electric element 17. For example, in the first lead frame 16*a*, a groove is formed in an upper part of the first placing portion 16*a*2. Further, in the third lead frame 16*c*, a groove is formed in an upper part of the third placing portion 16*c*2. Further, in the third placing portion 16*c*2 of the third lead frame 16*c*, a notch is formed between an arrangement position of the first electric element 17*a* and an arrangement position of the second electric element 17*b*. When solder such as cream solder is applied to the placing portion by forming the boundary 160 such as a groove or a notch in the lead frame 16, the solder can be prevented from flowing beyond the boundary 160 due to surface tension of the applied solder. Note that it is also possible to form the boundary 160 as a wall protruding from the lead frame 16.

<Method for Manufacturing Switch Device 1>

Figure 5:
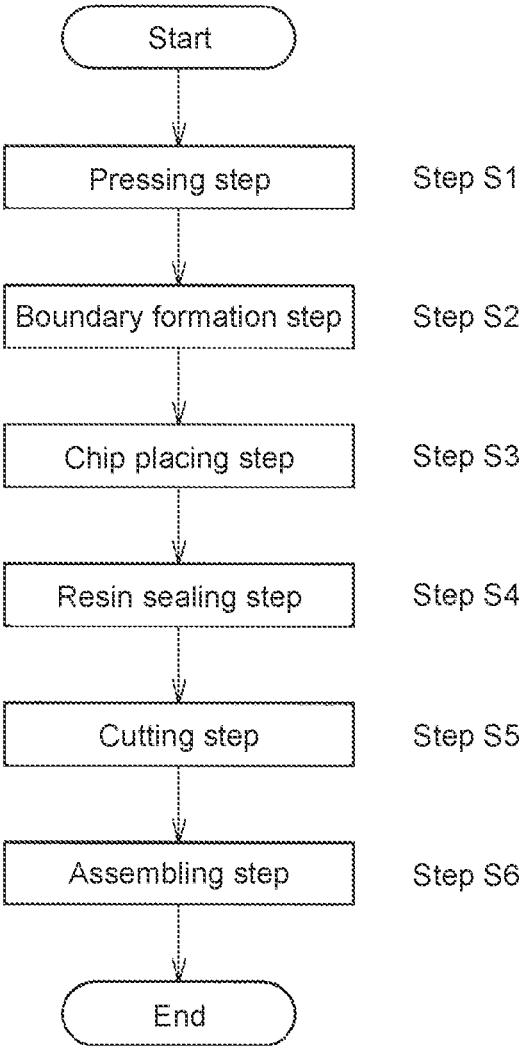
FIG. 5 is a schematic diagram illustrating a flowchart of an example according to a method for manufacturing a switch device according to one or more embodiments.

Next, a method for manufacturing the switch device 1 disclosed herein will be described. FIG. 5 is a flowchart schematically illustrating an example of steps according to the method of manufacturing the switch device 1 disclosed herein. As step S1 of the manufacturing method, a pressing step of pressing a conductive metal plate is performed (step S1). The pressing step is a step of punching a metal plate by pressing to form a shape of the lead frame 16. A prototype of the lead frame 16 immediately after the punching is connected to what is called "frame bar", and the three members are connected together as one.

After the pressing step, a boundary formation step of forming the boundary portion 160 such as a groove or a notch is performed on the punched prototype of the lead frame 16 (step S2).

After the boundary formation step, a chip placing step of placing the surface mount type electric element 17 on the lead frame 16 and soldering the electric element 17 is performed (step S3). The chip placing step is a step of applying cream solder to the placing portion on which the electric element 17 is to be placed among the first placing portion 16*a*2, the second placing portion 16*b*1, and the third placing portion 16*c*2, and soldering the placing portion by reflow. The boundary 160, which is formed prior to the application of the solder cream, can prevent the solder cream from flowing out.

After the chip placing step, a resin sealing step of sealing (molding) the electric element 17 placed on the lead frame 16 with resin and, thus, forming the mold body 13 is performed (step S4).

After the resin sealing step, a cutting step of cutting the lead frame 16 connected to the frame bar and cutting off the lead frame, together with the integrated mold body 13, from the frame bar is performed (step S5). In the cutting step, an unnecessary terminal 12 is also cut.

Figure 6:
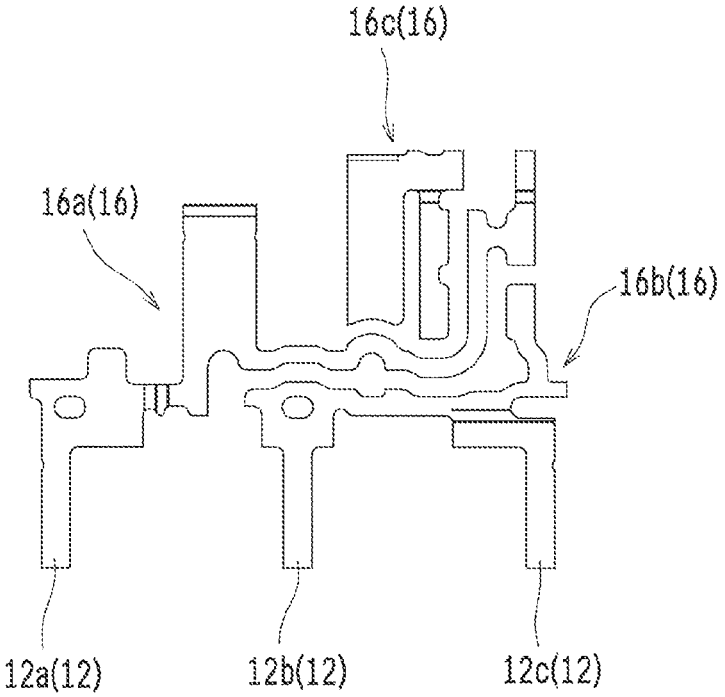
FIG. 6 is a diagram illustrating a schematic perspective view of an example of a lead frame incorporated in a switch device according to one or more embodiments.

FIG. 6 is a schematic perspective view illustrating an example of the lead frame 16 incorporated in the switch device 1 disclosed herein. FIG. 6 illustrates a state before the unnecessary terminal 12 is cut in the cutting step in step S5. Note that the connection to the frame bar is not illustrated. As illustrated in FIG. 6, in the lead frame 16 before cutting, in addition to the first terminal 12*a* and the second terminal 12*b*, a third terminal 12*c* is formed at a right end of the second lead frame 16*b*. In the cutting step, the terminal 12 is appropriately cut in accordance with the use of an installation destination of the switch device 1. The lead frame 16 illustrated in FIG. 6 has a planar shape formed in the pressing step and the cutting step. It is therefore possible to simplify the steps as compared with, for example, a case where a step of bending or the like is performed to form a portion on which the electric element 17 is placed.

In the flowchart of FIG. 5, after the cutting step, an assembling step of assembling various members such as the mold body 13, the movable member 11, the movable contact 15, and the biasing member 14 in the casing 10 is performed (step S6), post-processing such as necessary inspection is performed, and the manufacturing of the switch device 1 is terminated.

<Circuit Configuration of Switch Device 1>

Figure 7:
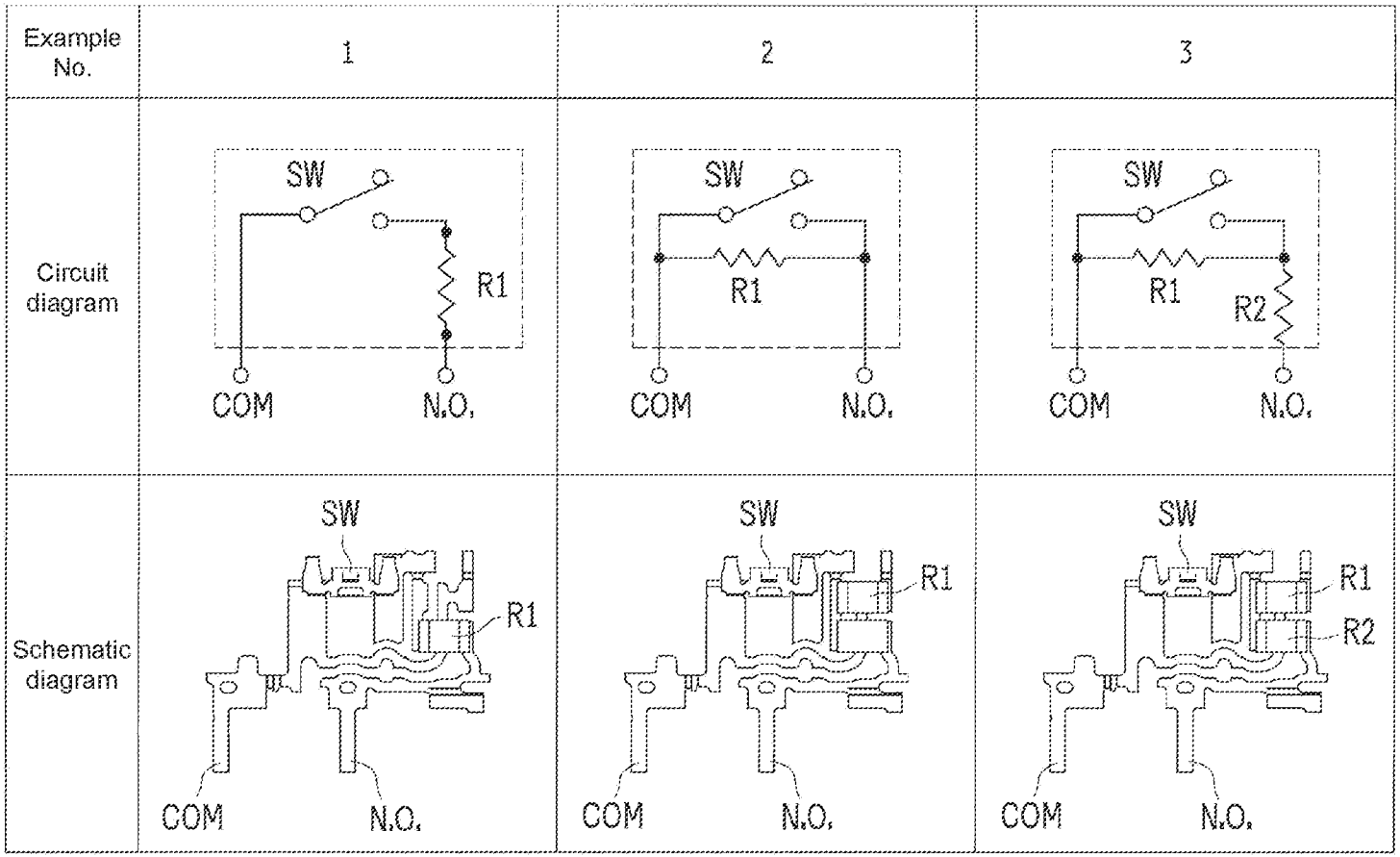
FIG. 7 is a table illustrating an example of a circuit configuration of a switch device according to one or more embodiments.

Next, an example of the circuit configuration of the switch device 1 will be described. FIG. 7 is a table illustrating an example of the circuit configuration of the switch device disclosed herein. FIG. 7 is an example of a circuit in which the contact-separation mechanism and the electric element 17 are connected in series in the switch device 1 disclosed herein, and illustrates circuit diagrams and schematic diagrams in Example 1, Example 2, and Example 3.

Example 1 has a configuration of the A contact specification in which the second placing portion 16*b*1 and the third placing portion 16*c*2 are bridged by the second electric element 17*b* including a resistor R1, the third terminal 12*c* is cut, the first terminal 12*a* is a COM terminal, and the second terminal 12*b* is an N.O. terminal. By measuring a resistance value between the COM terminal and the N.O. terminal in the drawing, it is possible to detect a short circuit of an external device connected to the switch device 1. In a normal state, when the movable member 11 is opened, the circuit is in an open state and the resistance value is a resistance at time of opening, that is, substantially infinite. When the movable member 11 is pressed, the circuit is in a closed state, and the resistance value is R1. When a short circuit occurs, the resistance value is a resistance value at time of short circuit (the resistance value varies depending on a site of the short circuit). Therefore, the short circuit can be detected by measuring the resistance value.

Example 2 has a configuration in which the first placing portion 16*a*2 and the third placing portion 16*c*2 are bridged by the first electric element 17*a* including the resistor R1, the second placing portion 16*b*1 and the third placing portion 16*c*2 are bridged by a jumper wire not including the electric element 17, and the third terminal 12*c* is cut. Example 2 has a configuration of the A contact specification in which the first terminal 12*a* is a COM terminal and the second terminal 12*b* is an N.O. terminal. By measuring a resistance value between COM and N.O. in the drawing, it is possible to detect disconnection of an external device connected to the switch device 1. In the normal state, when the movable member 11 is opened, the circuit is in an open state, and the resistance value is R1. When the movable member 11 is pressed, the circuit is in a closed state, and the resistance value is a resistance value Rsw (Rsw<<R1) of a switch SW (contact-separation mechanism). When a disconnection occurs, the resistance value is a resistance in an open state, that is, infinite. Therefore, the disconnection can be detected by measuring the resistance value.

Example 3 has a configuration in which the first placing portion 16*a*2 and the third placing portion 16*c*2 are bridged by the first electric element 17*a* including the resistor R1, the second placing portion 16*b*1 and the third placing portion 16*c*2 are bridged by the second electric element 17*b* including the resistor R2, and the third terminal 12*c* is cut. Example 3 has a configuration of the A contact specification in which the first terminal 12*a* is a COM terminal and the second terminal 12*b* is an N.O. terminal. By measuring a resistance value between COM and N.O. in the drawing, it is possible to detect a short circuit and a disconnection of an external device connected to the switch device 1. In the normal state, when the movable member 11 is opened, the circuit is in an open state, and the resistance value is R1+R2. When the movable member 11 is pressed, the circuit is in a closed state, and the resistance value is R2. When a short circuit occurs, the resistance value is the resistance value at the time of short circuit. Further, when a disconnection occurs, the resistance value is a resistance in an open state, that is, infinite. Therefore, a short circuit and disconnection can be detected by measuring the resistance value.

Figure 8A:
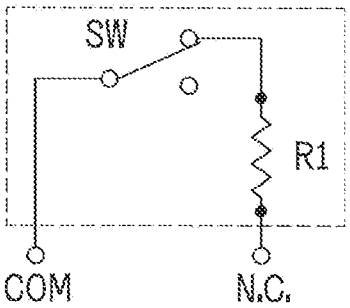
FIG. 8A is a circuit diagram illustrating an example of a circuit configuration of a switch device according to one or more embodiments.
Figure 8B:
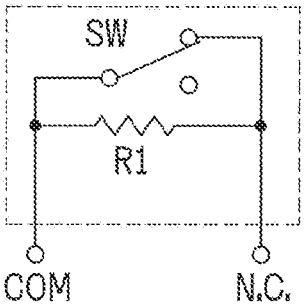
FIG. 8B is a circuit diagram illustrating an example of a circuit configuration of a switch device according to one or more embodiments.
Figure 8C:
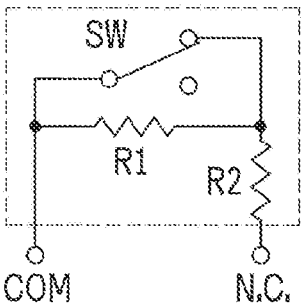
FIG. 8C is a circuit diagram illustrating an example of a circuit configuration of a switch device according to one or more embodiments.

The switch device 1 disclosed herein can be configured not only as the switch device 1 having the A contact specification described with reference to FIG. 7 but also as the switch device 1 having the B contact specification. FIGS. 8A, 8B, and 8C are circuit diagrams each illustrating an example of the circuit configuration of the switch device 1 disclosed herein. FIGS. 8A, 8B, and 8C are examples of a circuit configured to have the B contact specification.

FIG. 8A illustrates a circuit configured to have the B contact specification in which the switch SW (contact-separation mechanism) and the first electric element 17*a* including the resistor R1 are connected in series between the COM terminal and the N.C. terminal. By measuring the resistance value between the COM terminal and the N.C. terminal in the drawing, it is possible to detect a short circuit of an external device connected to the switch device 1. In the normal state, when the movable member 11 is opened, the circuit is in a closed state, and the resistance value is R1. When the movable member 11 is pressed, the circuit is in a closed state, and the resistance value is substantially infinite. When a short circuit occurs, the resistance value is the resistance value at the time of short circuit. Therefore, the short circuit can be detected by measuring the resistance value.

FIG. 8B illustrates a circuit configured to have the B contact specification in which the switch SW and the first electric element 17*a* including the resistor R1 are connected in parallel between the COM terminal and the N.C. terminal. By measuring the resistance value between COM and N.C. in the drawing, it is possible to detect disconnection of an external device connected to the switch device 1. In the normal state, when the movable member 11 is opened, the circuit is in a closed state and the resistance value is the resistance value Rsw (Rsw<<R1) of the switch SW (the contact-separation mechanism). When the movable member 11 is pressed, the circuit is in an open state, and the resistance value is R1. When a disconnection occurs, the resistance value is a resistance in an open state, that is, infinite. Therefore, the disconnection can be detected by measuring the resistance value.

FIG. 8C illustrates a circuit configured to have the B contact specification in which the switch SW and the first electric element 17*a* including the resistor R1 are connected in parallel between the COM terminal and the N.C. terminal, and the second electric element 17*b* including the resistor R2 is connected in series on the N.C. terminal side. In the normal state, when the movable member 11 is opened, the circuit is in a closed state, and the resistance value is R2. When the movable member 11 is pressed, the circuit is in an open state, and the resistance value is R1+R2. When a short circuit occurs, the resistance value is the resistance value at the time of short circuit. Further, when a disconnection occurs, the resistance value is a resistance in an open state, that is, infinite. Therefore, a short circuit and disconnection can be detected by measuring the resistance value.

Figure 9A:
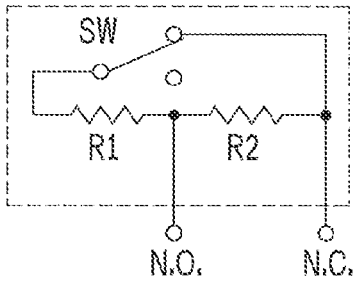
FIG. 9A is a circuit diagram illustrating an example of a circuit configuration of a switch device according to one or more embodiments.
Figure 9B:
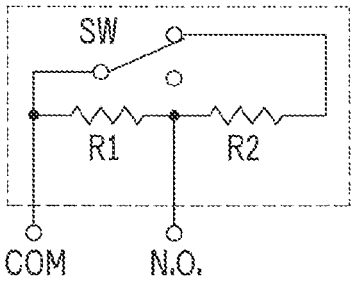
FIG. 9B is a circuit diagram illustrating an example of a circuit configuration of a switch device according to one or more embodiments.

In the circuit configuration, various circuits can be formed by appropriately designing a shape and connection form of the lead frame 16. FIGS. 9A and 9B are circuit diagrams illustrating an example of the circuit configuration of the switch device 1 disclosed herein. FIGS. 9A and 9B are examples of a circuit in which the resistors R1 and R2 as the electric elements 17 are connected in parallel and the contact-separation mechanism is combined.

FIG. 9A illustrates an example in which the N.O. terminal is taken from between the resistors R1 and R2, and the N.C. terminal is taken from between the resistor R2 and the switch SW (contact-separation mechanism). In the switch device 1 illustrated in FIG. 9A, a short-circuit and a disconnection of an external device connected to the switch device 1 can be detected by measuring a resistance value between N.O. and N.C. in the drawing. In the normal state, when the movable member 11 is opened, the circuit is in a closed state, and the resistance value is (R1×R2)/(R1+R2). When the movable member 11 is pressed, the circuit is in an open state, and the resistance value is R2. When a short circuit occurs, the resistance value is the resistance value at the time of short circuit. Further, when a disconnection occurs, the resistance value is a resistance in an open state, that is, infinite. Therefore, a short circuit and disconnection can be detected by measuring the resistance value.

FIG. 9B illustrates an example in which the COM terminal is taken from between the resistor R1 and the contact-separation mechanism, and the N.O. terminal is taken from between the resistors R1 and R2. In the switch device 1 illustrated in FIG. 9B, it is possible to detect a short circuit and a disconnection of an external device connected to the switch device 1 by measuring a resistance value between COM and N.O. in the drawing. In the normal state, when the movable member 11 is opened, the circuit is in a closed state, and the resistance value is (R1×R2)/(R1+R2). When the movable member 11 is pressed, the circuit is in an open state, and the resistance value is R1. When a short circuit occurs, the resistance value is the resistance value at the time of short circuit. Further, when a disconnection occurs, the resistance value is a resistance in an open state, that is, infinite. Therefore, a short circuit and disconnection can be detected by measuring the resistance value.

Figure 10:
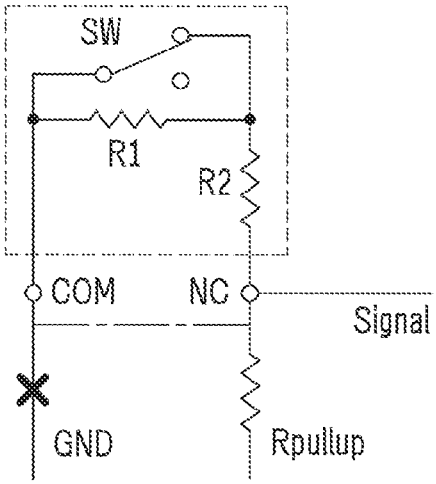
FIG. 10 is a schematic diagram illustrating an example of a circuit configuration with use of a switch device disclosed herein.

Next, an example in which the above circuit configuration is connected to an external device, such as an electric system of an automobile, and a state of the circuit is detected by a detection voltage will be described. FIG. 10 is a schematic diagram schematically illustrating an example of the circuit configuration with use of the switch device 1 disclosed herein. The circuit illustrated in FIG. 10 illustrates a configuration example in which the switch device 1 having the circuit configuration illustrated in FIG. 8C is connected to an external device such as an electrical component of an automobile with use of a 12 V DC power supply. The COM terminal is connected to the ground potential (GND), and the N.C. terminal is connected to a pull-up resistor Rpullup. Further, a detection voltage Signal is taken from between the N.C. terminal and the pull-up resistor Rpullup. The resistance values of the resistor R1, the resistor R2, and the pull-up resistor Rpullup are 1580Ω, 732Ω, and 1050Ω, respectively.

In the circuit illustrated in FIG. 10, when the movable member 11 is opened, the circuit is in a closed state, and the resistance value is R2+Rpullup, which is 1782Ω. In this case, the detection voltage Signal is 4.93 V. When the movable member 11 is pressed, the circuit is in an open state, and the resistance value is R1+R2+Rpullup, which is 3362Ω. In this case, the detection voltage Signal is 8.25 V. When a section indicated by a one-dot chain line in the drawing is short-circuited, the resistor is only Rpullup, and thus the detection voltage Signal is 0 V. When a section indicated by a mark "X" in the drawing is disconnected, a current does not flow, and thus the detection voltage Signal is 12 V.

As described above, the detection voltage Signal takes a value of about 5 V or about 8 V depending on the open or close state of the circuit in the normal state, and takes either a value of 0 V in a short-circuit state or a value of 12 V in a disconnection state. In this way, the open and close state of the switch device 1 and the state of the external device can be detected by the detection voltage Signal.

As described above, since the electric element 17 is surface-mounted on the lead frame 16 and is sealed with resin, the switch device 1 disclosed herein prevents deterioration such as corrosion due to the influence of moisture in the external atmosphere, sulfurized gas, and the like, maintains the reliability of the solder joint, and exhibits other excellent effects.

Further, as the boundary 160, such as a groove or a notch, is formed in the lead frame 16 along the outer edge of the arrangement position of the electric element 17, the switch device 1 disclosed herein can prevent the applied solder from flowing out, prevent deterioration of yield, and exhibit other excellent effects.

Further, in the switch device 1 disclosed herein, one or a plurality of electric elements 17 can be surface-mounted on the lead frame 16. Furthermore, the plurality of rectangular parallelepiped electric elements 17 is arranged side by side on the lead frame 16 in a manner in which long sides of one electric element are parallel to those of other electric element, and thus the switch device 1 disclosed herein is miniaturized and has other excellent effects.

Since the lead frame 16 is formed in a planar shape, the switch device 1 disclosed herein facilitates processing, simplifies steps, and exhibits other excellent effects.

The invention is not limited to the embodiments described above, and can be implemented in various other modes. Thus, the above embodiments are merely examples in all respects, and should not be construed in a limited manner. The technical scope of the invention is described by the claims, and is not restricted by the description at all. Furthermore, all modifications and changes falling within the equivalent scope of the claims are within the scope of the invention.

For example, in the above embodiment, the electric element 17 is surface-mounted on one surface side of the lead frame 16. However, the invention is not limited to this configuration, and can be developed into various modes. For example, the electric elements 17 can be surface-mounted on both surfaces of the lead frame 16. When the electric elements 17 are provided on both surfaces of the lead frame 16, it is possible to increase a degree of freedom in designing the circuit configuration, and it is possible to suppress the current flowing through one electric element 17 by arranging the electric elements 17 in parallel. By suppressing the current flowing through one electric element 17, the current flowing through the entire circuit can be increased and the electric element 17 having a low durable current can be used.

DESCRIPTION OF SYMBOLS

1 switch device
10 casing
11 movable member
12 terminal
12*a* first terminal
12*b* second terminal
12*c* third terminal
13 mold body
15 movable contact (contact-separation mechanism)
16 lead frame
16*a* first lead frame

16*a*1 first fixed contact (contact-separation mechanism)
16*a*2 first placing portion
16*b* second lead frame
16*b*1 second placing portion
16*c* third lead frame
16*c*1 second fixed contact
16*c*2 third placing portion
160 boundary
17 electric element
17*a* first electric element
17*b* second electric element

The invention claimed is:

1. A switch device comprising:

a plurality of lead frames that is conductive and configured to be electrically connectable to an external device;

a contact-separation mechanism configured to allow the plurality of lead frames to be electrically connected to and separated from each other; and an electric element configured to connect the plurality of lead frames to each other, wherein the electric element is surface-mounted on the plurality of lead frames, and is sealed with resin, and the plurality of electric elements has a substantially rectangular shape, and is arranged side by side on the plurality of lead frames in a manner in which long sides of one electric element are parallel to those of other electric element.

2. The switch device according to claim 1, further comprising a casing accommodating a part or all of the plurality of lead frames, the contact-separation mechanism, and the electric element that is sealed with resin on the plurality of lead frames.

3. The switch device according to claim 1, wherein the electric element is a single electric element.

4. The switch device according to claim 1, wherein the electric element is a plurality of electric elements.

5. The switch device according to claim 1, wherein each of the plurality of lead frames comprises a boundary disposed along an outer edge of an arrangement position of the electric elements.

6. The switch device according to claim 2, wherein the electric element is a single electric element.

7. The switch device according to claim 2, wherein the electric element is a plurality of electric elements.

8. The switch device according to claim 2, wherein each of the plurality of lead frames comprises a boundary disposed along an outer edge of an arrangement position of the electric elements.

9. A method for manufacturing a switch device including a plurality of lead frames that is conductive and configured to be electrically connectable to an external device, a contact-separation mechanism configured to allow the plurality of lead frames to be electrically connected to and separated from each other, and an electric element configured to connect the plurality of lead frames to each other, the method comprising:

forming the lead frames from a conductive plate;

placing the electric element on the plurality of lead frames;

sealing, with resin, the electric element and, thus, forming a mold body; and assembling components comprising the contact-separation mechanism and the mold body, wherein the plurality of electric elements has a substantially rectangular shape, and is arranged side by side on the plurality of lead frames in a manner in which long sides of one electric element are parallel to those of other electric element.

* * * * *